US007798611B2

(12) United States Patent
Connors et al.

(10) Patent No.: US 7,798,611 B2
(45) Date of Patent: Sep. 21, 2010

(54) CIRCUIT ROUTING FOR PRINTHEAD HAVING INCREASED CORROSION RESISTANCE

(75) Inventors: William B. Connors, Corvallis, OR (US); Terry E McMahon, Corvallis, OR (US); Donald W Schulte, Corvallis, OR (US); Keith Moore, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 429 days.

(21) Appl. No.: 11/452,678

(22) Filed: Jun. 13, 2006

(65) Prior Publication Data

US 2006/0232634 A1 Oct. 19, 2006

Related U.S. Application Data

(63) Continuation of application No. 10/003,938, filed on Oct. 31, 2001, now Pat. No. 7,083,265.

(51) Int. Cl.
*B41J 2/05* (2006.01)

(52) U.S. Cl. ..... 347/62; 347/63; 347/50

(58) Field of Classification Search ..... 347/51, 347/56–58, 62, 50, 49, 63, 64; 430/320
See application file for complete search history.

(56) References Cited

U.S. PATENT DOCUMENTS

| | | | | |
|---|---|---|---|---|
| 5,159,353 | A | 10/1992 | Fasen et al. | |
| 5,187,500 | A | 2/1993 | Bohorquez et al. | |
| 5,364,743 | A * | 11/1994 | O'Neill | 430/320 |
| 6,056,391 | A | 5/2000 | Kasamoto et al. | |
| 6,260,952 | B1 | 7/2001 | Feinn | |
| 6,450,617 | B1 * | 9/2002 | Kitani et al. | 347/50 |
| 6,481,831 | B1 * | 11/2002 | Davis et al. | 347/62 |

FOREIGN PATENT DOCUMENTS

JP 2000266715 A * 9/2000

* cited by examiner

*Primary Examiner*—Lam S Nguyen

(57) ABSTRACT

The present invention includes as one embodiment an ink jet printhead having a circuit with plural resistors and a power bus. The printhead includes a metal stack formed within the circuit, which is comprised of a first metal layer and a second metal layer and at least one power via. The power via is formed within the circuit as an interface between the first metal layer and the second metal layer and acts as a separation barrier between conductive portions of the resistors and the power bus.

3 Claims, 4 Drawing Sheets

CIRCUIT ROUTING FOR PRINTHEAD HAVING INCREASED CORROSION RESISTANCE

This is a continuation of application Ser. No. 10/003,938 filed on Oct. 31, 2001, issued U.S. Pat. No. 7,083,265, which is hereby incorporated by reference.

FIELD OF THE INVENTION

The present invention generally relates to inkjet printers and in particular to a system and method for implementing a routing scheme in the thin film circuitry of an ink jet printhead that increases the resistance to corrosion of other components of the thin film circuitry.

BACKGROUND OF THE INVENTION

Ink jet printhead cartridges typically use thin film circuitry with electrical contact points to provide power and communication for printing operations. Thin film circuits are used because they are very small, which is desired for the ink ejection portion of the printhead. Communications are used to instruct the ink ejection portion of the printhead to fire ink drops with thin film firing resistors of the circuit. These contact points are very small and have to be precisely positioned. As such, in many cases, each contact point is manufactured with close mechanical registration.

However, ink appearance at the printhead near the thin film circuitry during printing can occur under certain circumstances and has been one of the most influential factors affecting printhead reliability. Namely, ink accumulation can penetrate through the circuit traces and cause an electrical short, thereby rendering the printhead inoperable. To avoid this, thin film circuits typically have core protective layers that are usually non-permeable. Nevertheless, ink penetration can still occur from a side of the circuit, through an edge of a ground trace, and then to the active trace.

In addition, if a firing resistor in the thin film circuit blows or becomes damaged, protective layers of the circuit can be breached, thereby exposing the underlying circuitry to electrical shortage. Basically, the resistors in the thin film circuitry are arranged in discrete groups known as primitives. Each primitive has a number of resistors receiving signals from a controller through a common connection or bus that routes power to the thin film resistors residing in the primitive. Consequently, if one resistor in the primitive has an electrical short, the electrical short can be transferred to other resistors in the primitive, and to other primitives linked by the same bus.

Therefore, what is needed is a system and method that protects the printhead from ink, namely a printhead with increased protection from corrosion so that other components of the thin film circuitry are protected during ink leaks.

SUMMARY OF THE INVENTION

To overcome the limitations in the prior art described above, and to overcome other limitations that will become apparent upon reading and understanding the present specification, the present invention includes an embodiment for implementing a routing scheme in the thin film circuitry of an ink jet printhead that increases the resistance to corrosion of other components of the thin film circuit.

In general, the printhead assembly of this embodiment includes connection and processing circuitry, a printhead body, ink channels, a substrate, such as a semiconductor wafer (commonly referred to as a die), a nozzle member and a barrier layer located between the wafer and nozzle member. The nozzle member has heating elements in arrays (resistors), as well as plural nozzles coupled to respective ink channels and is secured at a predefined location to the printhead body with a suitable adhesive layer.

The nozzle member includes thin film circuitry with a power bus and a control or FET (field effect transistor) bus for providing power and operation signals to thin film firing resistors, respectively. The thin film circuitry includes a metal stack comprised of a first metal layer and a second metal layer. The second metal layer is conformed with plural vias that form an interface between the first metal layer and the second metal layer. Some of the vias form a separation barrier between the conductive portions of the thin film resistors and the power bus.

This is accomplished with a novel routing scheme. In particular, for a set of resistors or a primitive, the power source is routed to the power bus through power vias, which is routed to a conductive portion of the resistor. Also, the controller is routed from the FET bus to FET vias and then to the resistors. The routing scheme creates a separation barrier and termination point at the power via for preventing the spread of corrosion throughout the thin film circuit if ink contamination occurs. Each resistor is identified by at least one via that connects to the power bus and at least one via that connects to the FET bus, but preferably there are several vias for each connection. As such, ink contamination can be limited to a single resistor or very few resistors. Thus, if one resistor shorts or malfunctions, the affect on the printing process will be relatively limited due to the isolation of the power bus created by the vias.

The present invention as well as a more complete understanding thereof will be made apparent from a study of the following detailed description of the invention in connection with the accompanying drawings and appended claims.

BRIEF DESCRIPTION OF THE DRAWINGS

The present invention can be further understood by reference to the following description and attached drawings that illustrate the preferred embodiment. Other features and advantages will be apparent from the following detailed description of the preferred embodiment, taken in conjunction with the accompanying drawings, which illustrate, by way of example, the principles of the invention.

DETAILED DESCRIPTION OF THE PREFERRED EMBODIMENTS

In the following description of the invention, reference is made to the accompanying drawings, which form a part hereof, and in which is shown by way of illustration a specific example in which the invention may be practiced. It is to be understood that other embodiments may be utilized and structural changes may be made without departing from the scope of the present invention.

Figure 1:
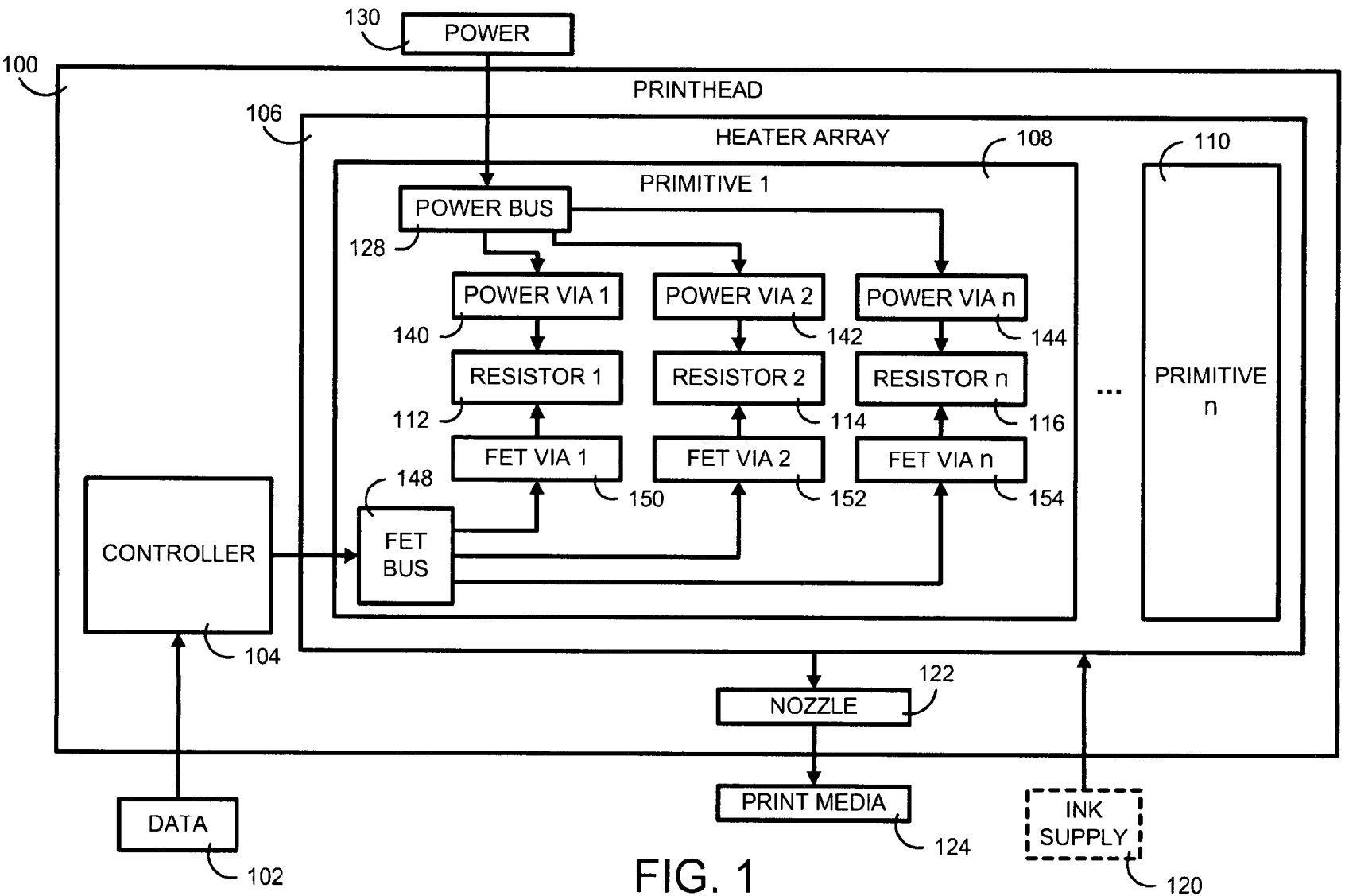
FIG. 1 is block diagram showing an embodiment with decode logic circuitry driving a single primitive.

I. General Overview:

FIG. 1 is a block diagram of one embodiment an exemplary printhead 100 showing the decode logic circuitry of a printhead. During operation of the printhead 100, data 102 is processed by a controller 104, such as a field effect transistor (FET) and electronic signals are sent to a heater array 106. The heater array 106 contains numerous primitives 1-n 108, 110. Each primitive contains groups of firing resistors 1, 2, . . . n, (shown as 112, 114, 116) which act as ohmic heaters when selectively energized by one or more pulses applied sequentially or simultaneously through one or more of the signals from the controller 104.

An ink supply 120, show with a dotted line because it can be a reservoir integrated with the printhead or a separate reservoir, supplies ink to an ink chamber with an array of chambers (not shown). The array of chambers is juxtaposed to the heater array 106 and associated resistors 112, 114, 116. When the chambers of the chamber array are heated, superheated ink vaporizes and is expelled as a droplet of ink through a nozzle 122 onto the print media 124. The nozzles 122 maybe of any size, number, and pattern.

As shown in FIG. 1, each resistor 1-n, 112, 114, 116 is related to an ink ejection element (not shown). The printhead 100 may be arranged into any number of multiple sub-sections with each sub-section having a particular number of primitives 108 containing a particular number of resistors. The thin film circuitry, including the resistors, can be arranged in any suitable manner to form the primitive groups. Each group or primitive receives electrical power signals through a power bus 128 from an external power source 130.

In one embodiment, each resistor 1-n 112, 114, 116 is associated with at least one power via and at least one FET via or controller via. Referring to FIG. 1, for a set of resistors or each primitive 108, the power source 130 is routed to the power bus 128 through power vias 1-n 140, 142, 144, to a conductive portion of the resistor. The FET bus 148, which is connected to the controller 104, is routed through FET vias 1-n 150, 152, 154 to the resistors 1-n 112, 114, 166.

This routing scheme creates a separation barrier and termination point at the power vias 140, 142, 144 for preventing the spread of corrosion throughout the thin film circuit if ink contamination occurs. Each resistor 1-n 112, 114, 116 is associated with at least one power via that connects to the power bus 128 and at least one FET via that connects to the FET bus 148. Preferably, there are several power and FET vias for each connection. As a result, ink contamination can be limited to a single resistor or very few resistors. Thus, if one resistor shorts or malfunctions, the affect on the printing process will be relatively limited due to the isolation of the power bus created by the vias.

Also, the resistors 1-n 112, 114, 116 in each primitive 1-n, 108, 110 are preferably below a protective layer and share the common power bus 128, independent of power to other primitives. The power from the power source 130 is routed from the power bus 128 either above or below the level of a thin film stack that contains the resistors 1-n, 112, 114, 116. Without the routing scheme of the present invention, if the protective layer over the resistors is compromised, ink can leak into the metal stack and result in ink corrosion. The corrosion could cause an electrical short in the resistor and in other resistors connected by the bus. The present invention prevents this problem. For example, if a resistor blows, the isolation of the present invention decreases penetration of ink within a primitive due to the exposure of metal to ink.

Figure 2:
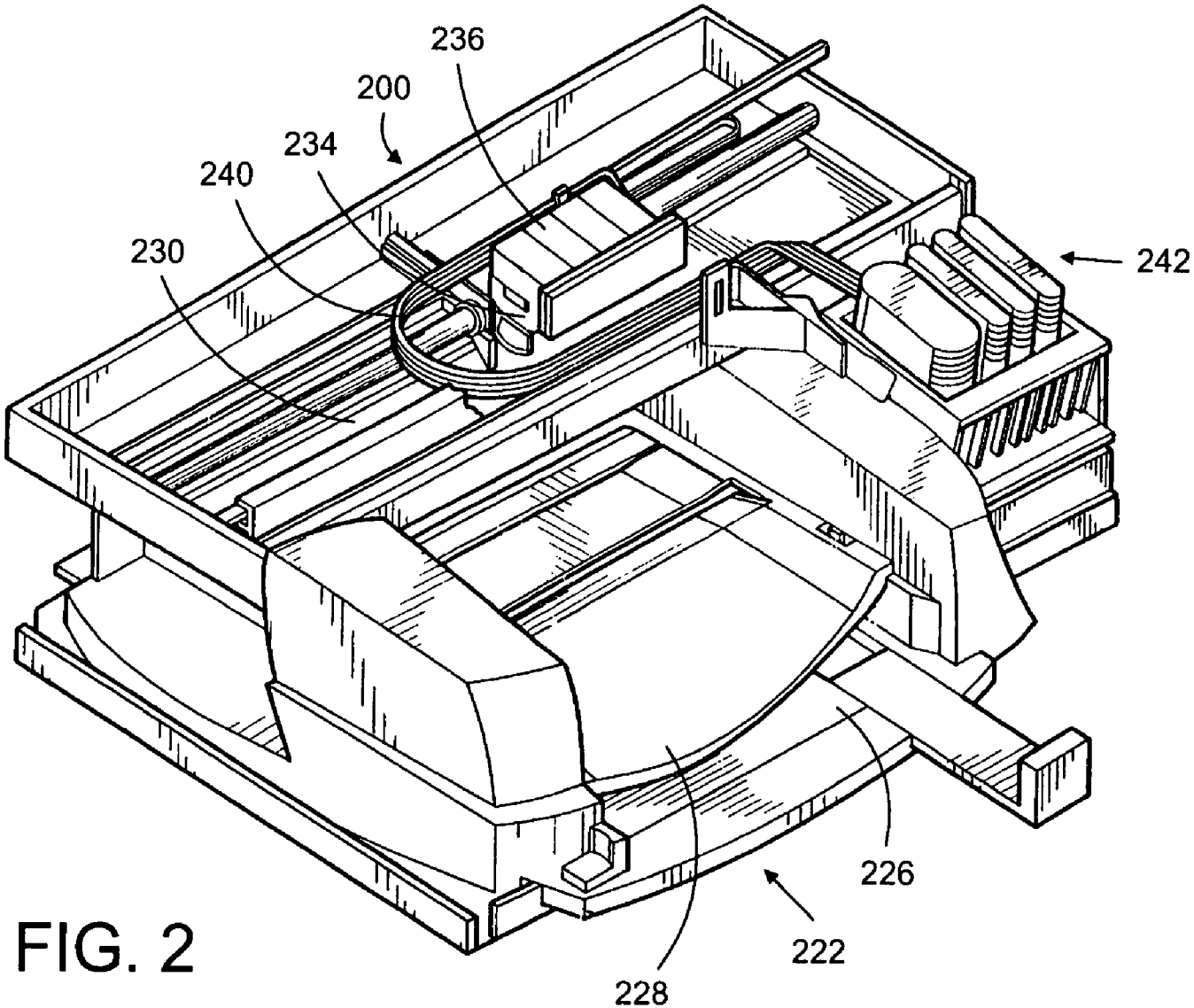
FIG. 2 is one embodiment with an exemplary printer that incorporates the invention and is shown for illustrative purposes only.

II. Exemplary Printing System:

FIG. 2 is one embodiment of an exemplary high speed printer that incorporates the invention and is shown for illustrative purposes only. Generally, printer 200 can incorporate the printing system 100 of FIG. 1A and further include a tray 222 for holding print media. When printing operation is initiated, print media, such as paper, is fed into printer 200 from tray 222 preferably using sheet feeder 226. The sheet then brought around in a U direction, then travels in an opposite direction toward output tray 228.

Other paper paths, such as straight paper path, can also be used. The sheet is stopped in a print zone 230, and a scanning carriage 234, supporting one or more printhead assemblies 236, is then scanned across the sheet for printing a swath of ink thereon. After a single scan or multiple scans, the sheet is then incrementally shifted using, for example a stepper motor or feed rollers to a next position within the print zone 230. Carriage 234 again scans across the sheet for printing a next swath of ink. The process repeats until the entire sheet has been printed, at which point it is ejected into the output tray 228.

The print assemblies 236 can be remove-ably mounted or permanently mounted to the scanning carriage 234. Also, the printhead assemblies 236 can have self contained ink reservoirs as the ink supply 112 of FIG. 1A. The self contained ink reservoirs can be refilled with ink for re-using the print assemblies 236. Alternatively, each print cartridge 236 can be fluidically coupled, via a flexible conduit 240, to one of a plurality of fixed or removable ink containers 242 acting as the ink supply 112 of FIG. 1A.

Figure 3:
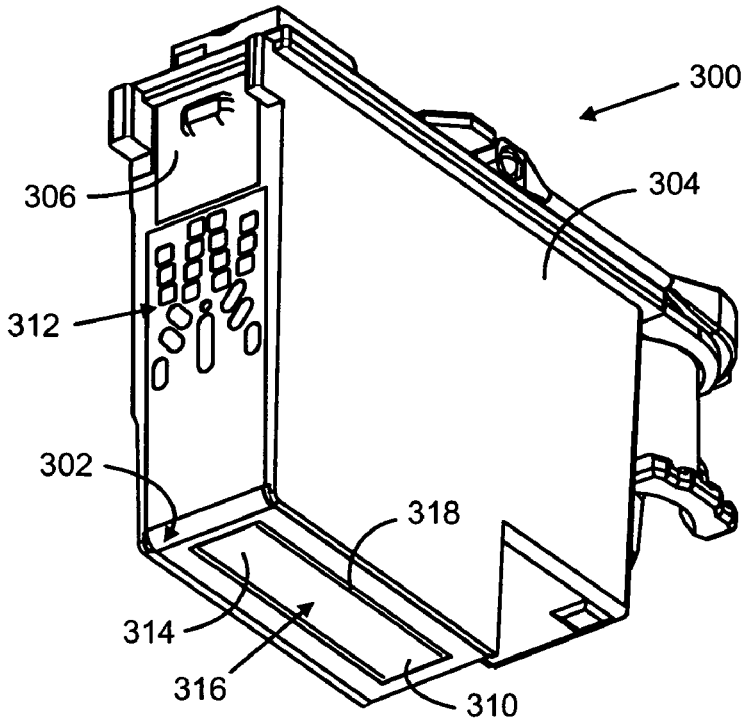
FIG. 3 shows one embodiment for illustrative purposes only a perspective view of an exemplary print cartridge incorporating the present invention.

FIG. 3 shows one embodiment for illustrative purposes only a perspective view of an exemplary printhead assembly 300 (an example of the printhead assembly 116 of FIG. 1A) incorporating the present invention. A detailed description of the present invention follows with reference to a typical printhead assembly used with a typical printer, such as printer 200 of FIG. 2. However, the present invention can be incorporated in any printhead and printer configuration.

Referring to FIGS. 1 and 2 along with FIG. 3, the printhead assembly 300 is comprised of a thermal inkjet head assembly 302, a printhead body 304 and a printhead memory device 306, which is an example of memory device 122. The thermal head assembly 302 can be a flexible material commonly referred to as a Tape Automated Bonding (TAB) assembly and can contain a processing driver head 310 and interconnected pads 312. The interconnected contact pads 312 are suitably secured to the print cartridge 300, for example, by an adhesive material. The contact pads 308 align with and electrically contact electrodes (not shown) on carriage 234 of FIG. 2.

The processing driver head 310 comprises a distributive processor 314 preferably integrated with a nozzle member 316. The distributive processor 314 preferably includes digital circuitry and communicates via electrical signals with the controller 110, nozzle member 316 and various analog devices, such as temperature sensors, which can be located on the nozzle member 316. The distributive processor 314 processes the signals for precisely controlling firing, timing, thermal and energy aspects of the printhead assembly 300 and nozzle member 316. The nozzle member 316 preferably contains plural orifices or nozzles 318, which can be created by, for example, laser ablation, for creating ink drop generation on a print media.

Figure 4:
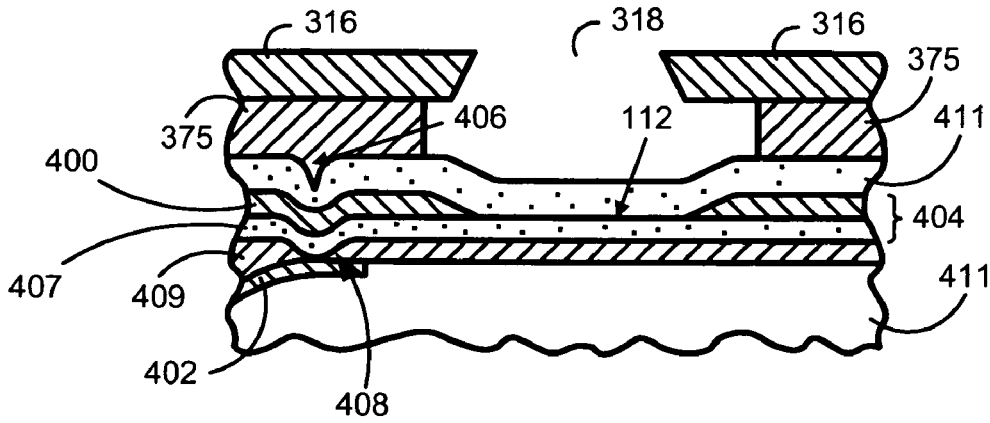
FIG. 4 shows one embodiment for illustrative purposes a cross section of the thin film circuitry and a via of a flexible circuit.

III. Working Example:

FIG. 4 illustrates a cross section of a portion of the printhead 100 of FIG. 1 in one embodiment, for illustrative purposes only. The layers of FIG. 4 are presented as an illustration and are not to scale. Referring to FIG. 1 and FIG. 2 along with FIG. 4, in one embodiment, the primitives 1-n 108, 110 are made of thin film circuitry and include a nozzle member 316 with nozzles 318 mounted on a barrier 375. Also included is a metal stack comprised of a first metal layer 402 and a second metal layer 404. The second metal layer 404 is conformed with plural vias 406 (FIG. 4 illustrates one via and one resistor for illustrative purposes only) and includes a top conductive metal 400 and metal 407, which at one portion is the resistor 112 and at another portion is a separation barrier 408. Also, other layers 411 can be included to help operation.

The vias 406 form an interface between the first metal layer 402 and the second metal layer 404 for providing power and control to the resistors. Also, the vias 406 form a blockade between the second metal layer 404 and a substrate 409. The substrate 409 could be tetraethylorthosilicate (TEOS) or some such other compound. The predefined vias 406 form the separation barrier 408 between conductive portions of a thin film resistor 112 and an associated power bus 128. The barrier 408 is preferably made of a non-corrosive material, such as Tantalum Aluminum. As a result, the electrical properties of the circuit are unaffected while decreasing the possibility of an electrical short.

In particular, the power bus 128 can be composed of stacked metal films, the second metal layer 404, such as Aluminum and the separation barrier 408, such as Tantalum Aluminum. Aluminum is used because it is very conductive and passes current from the printer's power supply to the thin film resistors 112, 114, 116 of the printhead 100 very efficiently. However, since Aluminum is very susceptible to corrosion when it contacts ink or other external liquids, isolation of the power bus from the ink is maintained to protect sensitive components providing critical signals.

Figure 5:
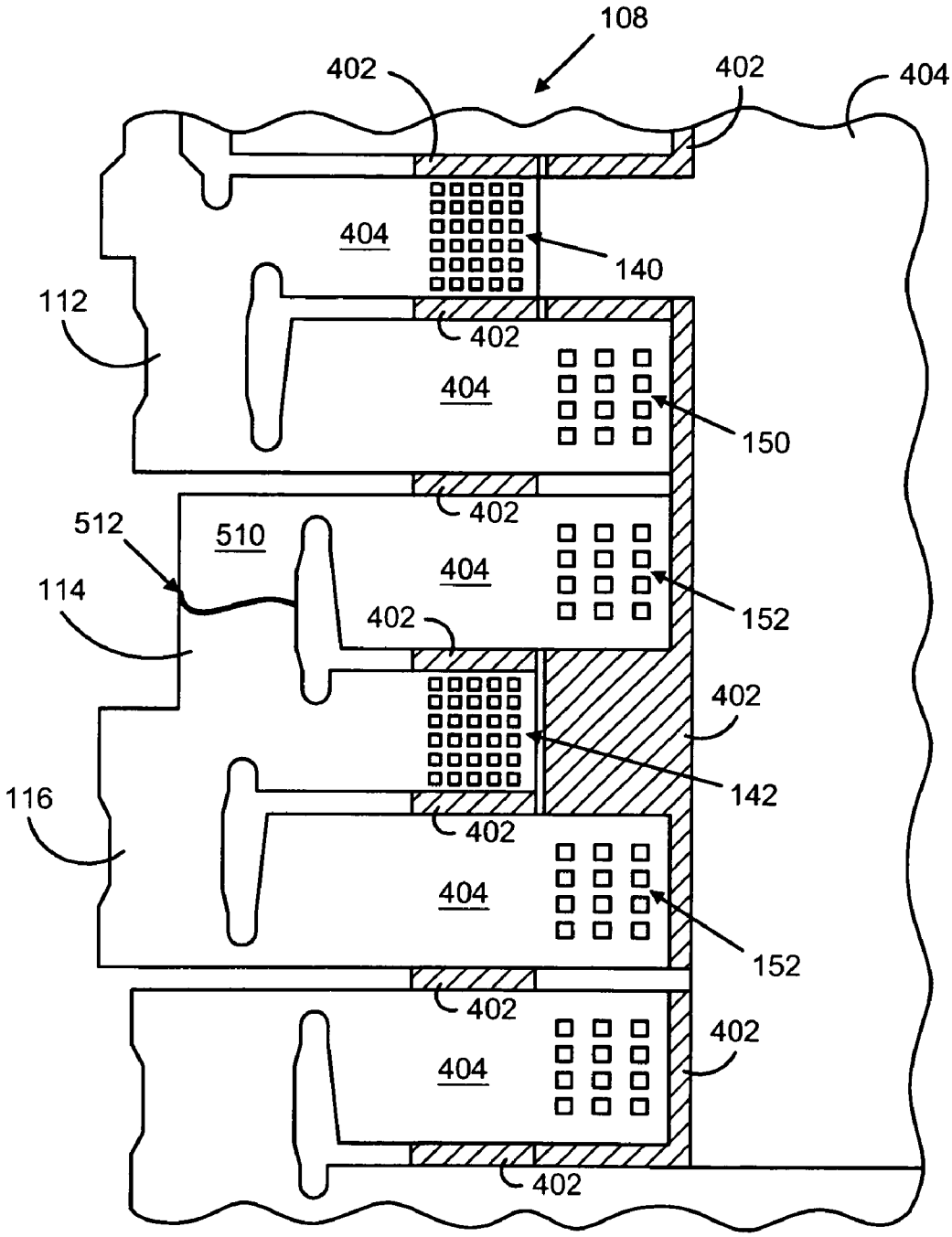
FIG. 5 shows one embodiment for illustrative purposes a working example of a primitive incorporating one embodiment of the invention.

FIG. 5 is one embodiment that shows a portion of a primitive of the printhead for illustrative purposes. Referring to FIG. 1 along with FIGS. 4-5, power is sent from the power bus 108 to the resistors 1-n 112, 114, 116 through the power vias 140, 142, 144. Control signals are sent to the resistors 1-n 112, 114, 116 through the FET vias 150, 152, 154. The vias 140, 142, 144, 150, 152, 154 are defined by the second metal layer 404 and the separation barrier 408 to create separation between the power bus and ink contamination.

The separation barrier 408 is relatively unaffected by ink corrosion. Referring to FIG. 5, if a resistor 510 (the same as resistor 114) blows, ink can contaminate the rest of the primitive 108. In other words, resultant loss of a protective layer allows ink to penetrate and corrode the second metal layer 404, causing a breach in the passivation layer and possibly an electrical short 512 in the blown resistor 510. However, the associated power via 140 and FET via 150 create a barrier which limits the corrosion. In this example, the short 512 only affects a single resistor 510 and other resistors in the primitive 108 are unaffected. The quality of print will therefore be minimally affected by the ink corrosion.

The invention claimed is:

1. A method of manufacturing a fluid ejection device, comprising:

providing a first metal layer comprising a power bus for receiving an electrical power signal and a separate FET bus for connecting with a controller;

providing a second metal layer, the second metal layer comprising a conductive layer portion and a corrosion-resistant layer portion;

providing a first electrical connection between the power bus and the second metal layer and a second electrical connection between the second metal layer and the FET bus, wherein the first and second electrical connections are made through the corrosion-resistant layer portion;

providing a via between the first metal layer and the second metal layer, wherein a portion of the corrosion-resistant layer portion at the via comprises a corrosion separation barrier between the conductive layer portion and the power bus for preventing the spread of corrosion if ink contamination occurs.

2. The method of claim 1, wherein the via comprises a power via.

3. The method of claim 1, wherein the via comprises a FET via.

* * * * *